US005932292A

United States Patent [19]

Nagashima et al.

[11] Patent Number: 5,932,292

[45] **Date of Patent: *Aug. 3, 1999**

[54] ZINC PHOSPHATE CONVERSION COATING COMPOSITION AND PROCESS

[75] Inventors: Yasuhiko Nagashima; Hitoshi Ishii, both of Kanagawa-Ken, Japan

[73] Assignee: Henkel Corporation, Gulph Mills, Pa.

[ * ] Notice: This patent issued on a continued prosecution application filed under 37 CFR 1.53(d), and is subject to the twenty year patent term provisions of 35 U.S.C. 154(a)(2).

[21] Appl. No.: 08/849,704

[22] PCT Filed: Dec. 6, 1995

[86] PCT No.: PCT/US95/15227

§ 371 Date: Jun. 6, 1997

§ 102(e) Date: Jun. 6, 1997

[87] PCT Pub. No.: WO96/17976

PCT Pub. Date: Jun. 13, 1996

[30] Foreign Application Priority Data

Dec. 6, 1994 [JP] Japan ..... 6-302289

[51] Int. Cl.[6] ..... B05D 5/12

[52] U.S. Cl. ..... 427/435; 427/443.2; 148/259; 148/262

[58] Field of Search ..... 148/259, 262; 427/435, 443.2

[56] References Cited

U.S. PATENT DOCUMENTS

| | | | |
|---|---|---|---|
| 2,471,908 | 5/1949 | Snyder | 148/6.15 |
| 3,642,541 | 2/1972 | Shepard | 148/6.15 |
| 3,645,806 | 2/1972 | Shaw et al. | 148/6.152 |
| 3,717,464 | 2/1973 | Tandy | 96/33 |
| 4,171,231 | 10/1979 | Bishop et al. | 148/6.21 |
| 4,233,087 | 11/1980 | Cooke | 148/6.152 |
| 4,321,128 | 3/1982 | Yoo | 208/114 |
| 5,312,492 | 5/1994 | Riesop et al. | 148/260 |
| 5,449,415 | 9/1995 | Dolan | 148/259 |
| 5,653,790 | 8/1997 | Fotinos et al. | 106/14.12 |

FOREIGN PATENT DOCUMENTS

| | | | |
|---|---|---|---|
| 1192515 | 10/1959 | France . | |
| 2410055 | 6/1979 | France | C23F 7/08 |
| 1941489 | 2/1970 | Germany | C23F 7/08 |
| 828916 | 2/1960 | United Kingdom . | |

OTHER PUBLICATIONS

Norio Sato et al., *Boshoku Gijutsu* (Corrosion Engineering), vol. 15, No. 5 (1966) pp. 12–18.

*Primary Examiner*—Benjamin Utech
*Assistant Examiner*—Duy-Vu Deo
*Attorney, Agent, or Firm*—Wayne C. Jaeschke; Norvell E. Wisdom, Jr.; Robert H. Berdo

[57] ABSTRACT

A zinc phosphate conversion coating which is accelerated only with nitrogen free organic peroxides is low-polluting and able to form uniform, fine, and dense conversion coatings that exhibit an excellent paint adherence when thin and excellent lubricity/lubricant carrier quality when thick.

18 Claims, No Drawings

ZINC PHOSPHATE CONVERSION COATING COMPOSITION AND PROCESS

TECHNICAL FIELD

This invention relates to zinc phosphate-based conversion treatment baths which can be applied to a variety of metal substrates, for example, steel, steel sheet, galvanized steel sheet, and the like. More particularly, this invention relates to a zinc phosphate-based conversion bath and to a surface treatment method that are able to form a fine, dense, and uniform conversion coating on metal surfaces and that are also able to induce fine-crystal formation in the conversion coating.

BACKGROUND ART

The execution of a zinc phosphate-based conversion treatment on various metals prior to the coating or plastic working thereof is known at present for the purpose of improving the paint adherence and post-paint corrosion resistance and improving the lubrication during plastic working.

The conversion treatment baths used for zinc phosphate-based conversion treatment are essentially acidic aqueous solutions that contain zinc ions, phosphate ions, and oxidizing agent(s). Nitrite salts, chlorate salts, hydrogen peroxide, organic nitro compounds, hydroxylamine, and the like, are ordinarily considered for this oxidizing agent. These oxidizing agents are typically called conversion "accelerators" because they function to accelerate the conversion reactions. Nitrate salts may be present in conversion baths, but—because, in the concentrations usually present in zinc phosphate-based conversion baths, nitrate ions do not exercise an oxidizing activity sufficient to convert ferrous ions substantially completely to ferric ions—nitrate ions must be distinguished from the conversion accelerators.

One important role of conversion accelerators during the zinc phosphate based conversion treatment of ferriferous metals is to oxidize the divalent iron ions eluting into the conversion bath to trivalent iron ions. For example, the conversion reactions are inhibited when divalent iron ions accumulate in the conversion bath during the continuous conversion treatment of ferriferous metals, and the role of the conversion accelerator in inhibiting this accumulation of divalent iron ions is thus crucial.

However, each of these already known conversion accelerators is associated with problems that must be addressed. For example, in the case of the nitrite salts, which are the most widely used conversion accelerators at the present time, these compounds are unstable in the acid region. As a result, these compounds undergo spontaneous decomposition and are thereby consumed even when conversion treatment is not being run (storage period). The maintenance of a constant or prescribed concentration of these compounds therefore requires continual replenishment to make up for the amount lost to this consumption.

It is also known that as a result of their oxidative activity and spontaneous decomposition these nitrite salts partially convert to $NO_x$ gas, which diffuses into and pollutes the atmosphere.

When chlorate salts are used as conversion accelerators, chloride ions are produced as a decomposition product during conversion treatment and accumulate in the conversion treatment bath. The corrosion resistance of the metal substrate is substantially impaired when even a trace of chloride ions from the conversion treatment bath remains on the surface of the metal workpiece. In addition, chlorate salts are ordinarily used in combination with another conversion accelerator, such as nitrite salts, and when used alone provide only a significantly reduced conversion reaction rate.

Stability in the conversion treatment bath is also a problem for the use of hydrogen peroxide as a conversion accelerator: Hydrogen peroxide is readily decomposed by oxygen dissolved in the conversion bath. In addition, hydrogen peroxide has a narrow optimal concentration range for conversion treatment, which makes it difficult to manage the conversion treatment bath. When the dissolved concentration is too high, a powdery, poorly adherent conversion coating is deposited on the metal surface.

With regard to the use of nitrogenous organic compounds as conversion accelerators, the following problems are associated with the use of organic nitro compounds such as nitroguanine and sodium m-nitrobenzenesulfonate: Nitroguanine, for example, has a low solubility in water and as a result cannot be formulated as a concentrate for addition to the conversion bath. It is also difficult to control the divalent iron ions concentration in the conversion bath using nitroguanine because this compound has a weak capacity to oxidize the divalent iron ions. On the other hand, sodium m-nitrobenzenesulfonate provides a poor conversion performance when used by itself, and for this reason this compound must ordinarily be used in combination with another, more powerful conversion accelerator. Moreover, its concentration management requires the use of large-scale measurement equipment, such as an ion chromatograph. Another problem with the use of organic nitro compounds is that the accumulation of these compounds and their decomposition products in the conversion bath causes an increase in the chemical oxygen demand ("COD") of the conversion treatment effluent, which unfavorably affects the environment.

Hydroxylamine compounds are another type of nitrogenous organic compounds used as conversion accelerators. These compounds, however, in order to achieve the best results, must be added to give concentrations of at least 1,000 parts per million by weight (hereinafter usually abbreviated as "ppm") in the conversion bath, giving rise to the possibility of a large and economically undesirable consumption of the conversion accelerator.

In addition, results have been reported from an investigation into the use of chromic acid and permanganate salts as conversion accelerators for zinc phosphate-based conversion treatment baths (Norio Sato, et al., *Boshoku Gijutsu* [English title: Corrosion Engineering], Volume 15, No. 5 (1966)).

These authors report that the formation of conversion coatings was not observed at concentrations of 5 millimoles per liter (hereinafter usually abbreviated as "mmol/L") or 10 mmol/L.

Many of the known conversion accelerators as described above are nitrogenous compounds, and as such resist removal by chemical wastewater treatment techniques, so that in practice they are usually removed through microbiological treatments. However, even with the use of microbiological treatments, the elimination of high concentrations of these nitrogenous compounds is highly problematic, while a complete elimination cannot be achieved even at low concentrations. Nitrogenous compounds have recently come to be thought of as one factor in the eutrophication of bodies of water, and the discharge of nitrogenous compounds has therefore become subject to an increasingly strict regulatory atmosphere. In view of these environmental considerations, the development of a nitrogenous compound-free zinc phosphate-based conversion bath would be highly desirable.

Another drawback to each of the above-described conversion accelerators is that, in order to obtain the thin, uniform, fine, and dense conversion coatings desired as underpaint coatings, the metal surface must in each case be conditioned by treatment with a colloidal titanium system immediately prior to execution of the conversion treatment. In addition to the fact that treatment bath management is quite complicated in the case of surface conditioners, a surface-conditioning step also requires installation of the corresponding treatment facilities and expansion of the space devoted to treatment. As a result, strong demand has recently appeared for the development of a conversion accelerator that is able to form high-quality conversion coatings on metal surfaces even without the implementation of a surface-conditioning step.

DISCLOSURE OF THE INVENTION

Problems to Be Solved by the Invention

The present invention seeks to solve the problems described above for conversion accelerators. More specifically, the present invention introduces a zinc phosphate-based conversion bath for metals and a metal surface treatment method which are able to deposit a fine, dense, and uniform zinc phosphate-type conversion coating on the surface of the metal substrate and which are able to induce fine-crystal formation in the conversion coating.

Description of the Invention, Including Preferred Embodiments

As a consequence of investigations focusing on organoperoxides within the realm of organic oxidizing agents, the inventors discovered that fine, dense, and uniform zinc phosphate-type conversion coatings can be formed through the use of organoperoxides soluble in the conversion bath as conversion accelerators. The following discoveries were also made: organoperoxide conversion accelerators need not be used in combination with nitrate salts or another conversion accelerator and thereby make possible the elimination of nitrogenous compounds from the conversion bath; the use of organoperoxide conversion accelerators yields fine, dense, and uniform crystals in the coating even without the application of a surface-conditioning treatment; and the use of organoperoxide conversion accelerators results in the formation of high-quality conversion coatings on metal substrates without being subject to narrow limitations of temperature, zinc concentration, and the like The present invention was developed as a result of these discoveries.

Since nitrogenous compounds are not included among the essential components of conversion baths according to the present invention, treatment baths according to the present invention can also satisfy environmental regulations concerning the amount of nitrogenous compound in the effluent. One should note in this connection that there is very little risk of environmental damage when the nitrogen concentration in a conversion treatment bath is less than or equal to 20 ppm.

In specific terms, then, the present invention relates to an acidic zinc phosphate-based conversion treatment aqueous liquid composition, usually hereinafter called a "bath" for brevity, for treating metal substrates, wherein said bath is characterized in that it contains zinc ions and phosphate ions as its main components and also contains organoperoxide(s) as a conversion accelerator.

The organoperoxide concentration in said conversion treatment bath is preferably 50 to 1,500 ppm.

The zinc phosphate-based treatment method according to the present invention for application to metal surfaces is characterized by contacting the metal surface with the above-described zinc phosphate-based conversion treatment bath according to the present invention after the pH of the conversion bath has been adjusted to 2.0 to 4.0.

Finally, the described zinc phosphate-based surface treatment according to the invention method is preferably carried out by subjecting the preliminarily degreased surface of the metal to a water rinse and consecutively thereafter to the conversion treatment.

The appropriate range for zinc ions concentration in a bath according to the invention will vary as a function of the service intended for the conversion coating produced, but as a general matter the preferred range for this concentration is 0.5 to 15.0 g/L.

For example, the formation of a conversion coating with a coating weight of around 0.5 to 10.0 g/m$^2$ is preferred when the conversion treatment bath according to the present invention is to be used to provide an underpaint coating for metals. The corresponding preferred zinc ions concentration range in the conversion bath will therefore be 0.5 to 5.0 g/L. When the zinc ions concentration falls below 0.5 g/L, the resulting zinc phosphate-type conversion coating will exhibit a reduced coverage ratio, which can cause an unsatisfactory post-paint coating adherence and an unsatisfactory post-paint corrosion resistance. Zinc ions concentrations in excess of 5.0 g/L cause a coarsening of the crystals in the coating, which can in particular cause a reduced post-paint coating adherence.

As another example, when the conversion treatment bath is to be used in support of the plastic working of metals, the formation of a thick conversion coating with a coating weight of around 5.0 to 15.0 g/m$^2$ is preferred in order to produce a conversion film capable of following the plastic deformation of the workpiece. In this case the preferred zinc ions concentration range in the conversion bath will be 5.0 to 15.0 g/L. It becomes difficult to obtain the prescribed coating weights for this application at zinc ions concentrations below 5.0 g/L. The coating weight no longer increases at above 15.0 g/L, which makes such values economically undesirable. The zinc ions can be provided by dissolving zinc oxide or zinc hydroxide in the acid component of the conversion bath or by dissolving a water-soluble zinc salt, such as the phosphate salt, sulfate salt, or the like, in the conversion bath.

The phosphate ions concentration in the conversion bath according to the present invention is preferably 5.0 to 30.0 g/L. Obtaining a normal conversion coating can become problematic at below 5.0 g/L. No additional benefits are obtained at above 30.0 g/L, which makes such values uneconomical. The phosphate ions can be generated by the addition of phosphoric acid or its aqueous solutions to the conversion bath or by dissolving a salt of phosphoric acid, such as the sodium, potassium, magnesium, zinc, or the like salt, in the conversion bath.

The zinc phosphate-based conversion treatment bath according to the present invention is an acidic aqueous solution whose pH preferably is from 2.0 to 4.0 and more preferably from about 2.5 to 3.5. In this pH region, orthophosphoric acid ($H_3PO_4$) exists in equilibrium primarily with dihydrogen phosphate ions ($H_2PO_4^-$), but also with much smaller amounts of hydrogen phosphate ions ($HPO_4^{-2}$) and phosphate ions ($PO_4^{3-}$); however, the concentrations specified herein as those of "phosphate ions" are intended to include the stoichiometric equivalent as phosphate ions of any of the chemical species from undissociated orthophosphoric acid to completely ionized phosphate ions. The free acid content, measured as described in the examples below, of the compositions according to the invention preferably is at least, with increasing preference in the order given, 0.1, 0.3, 0.5, or 0.6 point and independently preferably is not more than, with increasing preference in the order given, 1.5, 1.3, 1.2, 1.1, 1.0, or 0.9 point(s).

The organoperoxides used by the present invention can be classified into, for example, organoperoxides, such as ethyl hydroperoxide, isopropyl hydroperoxide, tert-butyl hydroperoxide, tert-hexyl hydroperoxide, diethyl peroxide, tert-butyl peroxymaleate, and the like, that contain a peroxy moiety without an adjacent carbonyl group; and percarboxylic acid types such as peracetic acid, monoperphthalic acid, persuccinic acid, and the like.

Organoperoxide molecules are preferably used at concentrations of 50 to 1,500 ppm in a conversion bath according to the invention. Acceleration of conversion film formation can become unsatisfactory when the organoperoxide concentration in the conversion bath is below 50 ppm. Accordingly, the organoperoxide molecules present in the conversion bath according to the present invention preferably contain $C_1$ to $C_7$ alkyl moieties, because a low water solubility is exhibited by organoperoxides containing aromatic or higher molecular weight alkyl moieties, and this can result in a failure to obtain a satisfactory oxidizing activity. On the other hand, no additional effect is obtained at concentrations in excess of 1,500 ppm, and such values are therefore uneconomical.

Because the conversion treatment bath according to the present invention also functions to induce fine-crystal formation on the part of the depositing zinc phosphate-type crystals, the instant conversion bath can produce a fine, dense, and uniform zinc phosphate-type conversion coating even in the absence of an immediately preceding surface-conditioning treatment for the specific purpose of inducing fine-crystal formation in the coating.

In addition, the conversion bath according to the present invention does not require the addition of nitric acid, nitrous acid, an organic nitro compound, or the like, and thus can be formulated entirely free of nitrogenous compounds. In this form it therefore offers the advantage of not requiring the inclusion of a treatment step for nitrogenous compounds in the effluent treatment process. Nitrogenous compounds may be added to the conversion treatment bath according to the present invention on an optional basis, but the nitrogen concentration is preferably held to no greater than 100 ppm and more preferably to 20 ppm or less.

Metal ions other than the zinc ions can be added to the zinc phosphate based conversion bath according to the present invention. These metal ions can act as etchants in order to induce a uniform etch of the surface of the metal workpiece, or can act as paintability improvers when the conversion coating is being used as an underpaint coating.

Suitable non-zinc metal ions are exemplified by nickel ions, manganese ions, cobalt ions, iron ions, magnesium ions, calcium ions, and so forth. Each of these ions can be provided by dissolution in the treatment bath of the oxide, hydroxide, carbonate, sulfate, phosphate, or the like, of the corresponding metal.

Fluoride ions or complex fluoride ions, e.g., fluosilicate ions, fluozirconate ions, and the like, can be used as etchant. These ions can be provided, for example, by dissolving in the conversion treatment bath one or more of the following fluorine compounds: hydrofluoric acid, fluosilicic acid, fluozirconic acid, fluotitanic acid, and the corresponding metal salts (e.g., sodium, potassium, magnesium).

The following process steps preferably should be consecutively executed in the sequence given in order to form a conversion coating on metal surfaces using a zinc phosphate based conversion bath according to the present invention: alkaline degreasing, a water rinse, treatment with the zinc phosphate-based conversion bath, and a water rinse. The degreasing and water rinse processes may themselves each be implemented as multistage processes. A deionized water rinse is preferably used for the final water rinse when the conversion coating will be used as an underpaint coating. Moreover, when the conversion coating is produced on a metal surface for use as an underpaint coating, it is preferred that the conversion treatment be immediately preceded by a surface conditioning process using a colloidal titanium-containing surface conditioner for the purpose of inducing fine-crystal formation in the coating.

Metals subjected to the above-described conversion treatment can be painted after the final water rinse as described above or after a drying step that follows the final water rinse.

When plastic working is the intended service for the conversion film formed on a metal substrate using the conversion bath according to the present invention, after the above-described degreasing and water rinse the metal workpiece is preferably subjected to a pickling step for purposes of descaling. Again with reference to production of the conversion film for plastic working service, the lubricity of the coating can be improved even further by a soap treatment (lubrication treatment) after formation of the conversion film.

Surface treatment using the zinc phosphate-based conversion bath according to the present invention is generally executed by immersion, spraying, or a combination thereof. When the conversion film is intended as an underpaint coating, the desired coating can be, and preferably is, formed by conversion treatment at a treatment temperature from about room temperature to about 60° C. and at a treatment time from about 0.5 minute to about 5 minutes. When the conversion film is intended for plastic working service, the desired coating can be, and preferably is, formed by conversion treatment at a treatment temperature from about 50° C. to about 90° C. and at a treatment time from about 1 minute to about 15 minutes.

The invention will be explained in greater detail below with reference to the following working and comparative examples of actual treatment. The scope of the present invention is in no way limited by these examples.

EXAMPLES

The test materials were (1) 0.8 mm-thick cold-rolled steel sheets (SPCCSD, abbreviated below as "SPC") and (2) galvanized steel sheets (abbreviated below as "plated") prepared by the zinc electroplating (20 g/m$^2$) of the aforementioned cold-rolled steel sheets. These were in each case cut to 70×150 mm and subjected to treatment in the working and comparative examples described below.

The following treatment process steps, which are a typical example of treatment for the purpose of producing an underpaint coating, were used in the working and comparative examples:

(1) degreasing (alkaline degreaser, brand name: FINECLEANER™ L4460 from Nihon Parkerizing Company, Limited, 20 g/L of constituent A, 12 g/L of constituent B);

43° C., 120 seconds, immersion;

(2) water rinse (tap water);

ambient temperature, 30 seconds, spray;

(3) surface conditioning (colloidal titanium surface conditioner, brand name: PREPALENE® ZN from Nihon Parkerizing Company, Limited, 1 g/L aqueous solution);

ambient temperature, 30 seconds, spray;

(4) zinc phosphate-based conversion treatment (as described below for the individual working and comparative examples);

43° C., 120 seconds, immersion;

(5) water rinse (tap water);

ambient temperature, 30 seconds, spray;

(6) deionized water rinse (deionized water, conductivity=0.2 microS/cm)

ambient temperature, 20 seconds, spray;

(7) drain and dry;

hot air at 110° C., 180 seconds, except that the surface-conditioning step was not carried out in Examples 5 and 7 or in Comparative Example 3, and in these cases the zinc phosphate-based conversion treatment step (4) was therefore carried out directly after the degreasing (1) and ensuing water rinse (2) steps.

The free acidity in the zinc phosphate-based conversion baths in Examples 1 to 8 and Comparative Examples 1 to 4 was adjusted to specific values using sodium hydroxide. The free acidity was measured by titrating 10 milliliters (hereinafter usually abbreviated as "mL") of the particular treatment bath to neutrality with 0.1 N aqueous sodium hydroxide, using bromophenol blue as the indicator. The number of mL of the 0.1 N aqueous sodium hydroxide required for the color change from yellow to blue was determined and is reported as "points" of free acidity. The fluoride ions concentration in the conversion bath was measured using a fluoride sensitive electrode.

The coating weight was measured as follows: The weight (W1) in grams of the treated sheet after conversion treatment was first measured, and the treated sheet was then subjected to a film stripping treatment using the stripping solution and stripping conditions reported below. The weight of the stripped sheet was measured to give W2 in grams, and the coating weight was calculated from the following equation:

$$\text{Coating weight (in g/m}^2\text{)}=(W1-W2)/0.021.$$

Treatment for cold-rolled steel sheets stripping solution: 5% aqueous chromic acid solution stripping conditions: 75° C., 15 minutes, immersion Treatment for galvanized steel sheets stripping solution: 2% by weight (hereinafter usually abbreviated as "wt %") of ammonium dichromate+49 wt % of 28 wt % aqueous solution of ammonia+49 wt % pure water stripping conditions: ambient temperature, 15 minutes, immersion.

The appearance of the coatings was inspected visually, and the morphology and size of the grains in the conversion coating was evaluated by inspection with a scanning electron microscope (SEM).

Example 1

Composition of the conversion bath phosphate ions: 15 g/L (from addition of 75% phosphoric acid)

zinc ions: 1.3 g/L (from addition of zinc oxide)

nickel ions: 1.0 g/L (from addition of nickel carbonate)

manganese ions: 0.5 g/L (from addition of manganese carbonate)

fluoride ions: 100 ppm (from addition of 55% hydrofluoric acid)

450 ppm of tert-butyl hydroperoxide (organoperoxide component) was added to the conversion bath with the above composition, and the free acidity of the conversion bath was then adjusted to 0.9 point. A cold-rolled steel test sheetpon was subjected first to the colloidal titanium surface-conditioning treatment and then to conversion treatment (conversion temperature=43° C., treatment time=120 seconds) using the above-described conversion bath. The resulting conversion coating weight was 1.2 g/m$^2$. The coating crystals were plates with an average grain size of 6 micrometers. The conversion coating was grayish black and was uniform, fine, and dense.

Example 2

A galvanized steel test sheet was subjected first to the same surface conditioning treatment as in Example 1 and then to conversion treatment using the same conversion treatment bath as in Example 1. The resulting conversion coating weight was 2.8 g/m$^2$. The crystals were plates with an average grain size of 4 micrometers. The conversion coating was grayish white and was uniform, fine, and dense.

Example 3

A cold-rolled steel test sheet was subjected first to the same surface-conditioning treatment as in Example 1 and then to conversion treatment using the same conversion treatment bath as in Example 1, except that the organoperoxide addition consisted of 80 ppm tert-butyl hydroperoxide and the free acidity was adjusted to 0.6 point. The resulting conversion coating weight was 0.9 g/m$^2$. The coating crystals were plates with an average grain size of 8 micrometers. The conversion coating was grayish black and was uniform, fine, and dense.

Example 4

A cold-rolled steel test sheet was subjected first to the same surface conditioning treatment as in Example 1 and then to conversion treatment using the same conversion treatment bath as in Example 1, except that 1,200 ppm of tert-butyl hydroperoxide was added as the organoperoxide and sufficient 65.5% nitric acid was added to give a nitrogen component content of 500 ppm. The free acidity of the conversion bath was adjusted to 0.9 point. The resulting conversion coating weight was 1.1 g/m$^2$. The coating crystals were plates with an average grain size of 7 micrometers. The conversion coating was grayish black and was uniform, fine, and dense.

Example 5

A cold-rolled steel test sheet was subjected to conversion treatment as in Example 1, except that there was no surface-conditioning treatment and only 400 ppm of tert-hexyl hydroperoxide was added as the organoperoxide. The free acidity was adjusted to 0.9 point. The resulting conversion coating weight was 1.0 g/m$^2$. The coating crystals were plates with an average grain size of 6 micrometers. The conversion coating was grayish black and was uniform, fine, and dense.

Example 6

A cold-rolled steel test sheet was subjected first to the same surface conditioning treatment as in Example 1 and then to conversion treatment using the same conversion treatment bath as in Example 1, except that 100 ppm of peracetic acid was added as the organoperoxide, and the free acidity was adjusted to 0.6 point. The resulting conversion coating weight was 1.3 g/m$^2$. The coating crystals were plates with an average grain size of 10 micrometers. The conversion coating was grayish black and was uniform, fine, and dense.

Example 7

A cold-rolled steel test sheet was subjected to conversion treatment using the same conversion bath as in Example 1, except that the surface conditioning treatment was not used, 500 ppm of tert-butyl hydroperoxide was added as the organoperoxide, and the free acidity was adjusted to 0.6 point. The resulting conversion coating weight was 1.1 g/m$^2$. The coating crystals were plates with an average grain size of 10 micrometers. The conversion coating was grayish black and was uniform, fine, and dense.

Example 8

Composition of the conversion bath phosphate ions: 15 g/L (from addition of 75% phosphoric acid)

zinc ions: 1.3 g/L (from addition of zinc oxide)

nickel ions: 1.0 g/L (from addition of nickel nitrate)

manganese ions: 0.5 g/L (from addition of manganese carbonate)

fluoride ions: 100 ppm (from addition of 55% hydrofluoric acid)

nitrate ions 7.2 g/L (from addition of sodium nitrate and nickel nitrate) (nitrogen concentration=1.4 g/L).

450 ppm of tert-butyl hydroperoxide (organoperoxide component) was added to the conversion bath with the above composition, and the free acidity of the conversion bath was then adjusted to 0.9 point. A cold-rolled steel test sheetpon was subjected first to the colloidal titanium surface-conditioning treatment and then to conversion treatment (conversion temperature=43° C., treatment time=120 seconds) using the above-described conversion bath. The resulting conversion coating weight was 1.1 g/m$^2$. The coating crystals were plates with an average grain size of 5 micrometers. The conversion coating was grayish black and was uniform, fine, and dense.

Comparative Example 1

A cold-rolled steel test sheet was subjected to the same surface conditioning treatment as in Example 1 and was then submitted to the same conversion treatment as in Example 1, except that the organoperoxide addition consisted of 5 ppm of tert-butyl hydroperoxide. The conversion coating weight was 0.5 g/m$^2$, and the development of yellow rust was observed.

Comparative Example 2

A galvanized steel test sheet was subjected to conversion treatment as in Example 1, except that the organoperoxide addition consisted of 5 ppm of tert-butyl hydroperoxide. The conversion coating weight was 0.9 g/m$^2$, the average grain size was 15 micrometers, and the coating was sparse.

Comparative Example 3

A cold-rolled steel test sheet was subjected to conversion treatment as in Example 8, except that there was no surface-conditioning treatment and 150 ppm of nitrite salt was added to the conversion bath in place of the organoperoxide. The conversion coating weight was 0.1 g/m$^2$, which indicated that almost no conversion coating deposition had occurred. Yellow rust had developed over the entire surface.

Comparative Example 4

A cold-rolled steel test sheet was subjected to conversion treatment as in Example 1, except that sodium chlorate was added to the conversion bath in place of the organoperoxide. The sodium chlorate was added to give a chlorate ions concentration of 1.5 g/L. The conversion coating weight was 0.9 g/m$^2$. The coating crystals were columnar and the average grain size was 15 micrometers. The conversion coating was sparsely deposited, and yellow rust was observed.

The conditions and results of these examples are summarized in Table 1 below.

The organoperoxide concentrations used in Examples 1 to 8 were 50 to 1,500 ppm. It was thereby demonstrated that this concentration range produced a good-quality conversion coating on cold-rolled steel sheet as well as galvanized steel sheet. A uniform, dense, and fine coating was obtained even when the surface conditioning treatment was not used.

In contrast, Comparative Examples 1 and 2 used organoperoxide concentrations below 50 ppm, and it was found that in these cases the oxidation activity by the conversion accelerator was inadequate, resulting in the deposition of scattered coating crystals. The uniformity of the coating on the basis metal was therefore diminished.

Comparative Examples 3 and 4 used non-organoperoxide conversion accelerators. In Comparative Example 3, a nitrite salt was used as the conversion accelerator and no surface-conditioning treatment was carried out. It was found

TABLE 1

| Examples And Comparative Examples | Substrate | Phosphate Ions, g/L | Zinc Ions, g/L | Nitrogen Concentration, ppm | Surface Conditioning | Oxidizing Agent * |
|---|---|---|---|---|---|---|
| Example 1 | SPC | 15 | 1.3 | 0 | yes | a |
| Example 2 | plated | 15 | 1.3 | 0 | yes | a |
| Example 3 | SPC | 15 | 1.3 | 0 | yes | a |
| Example 4 | SPC | 15 | 1.3 | 500 | yes | a |
| Example 5 | SPC | 15 | 1.3 | 0 | no | b |
| Example 6 | SPC | 15 | 1.3 | 0 | yes | c |
| Example 7 | SPC | 15 | 1.3 | 0 | no | a |
| Example 8 | SPC | 15 | 1.3 | 1400 | yes | a |
| Comparative Example 1 | SPC | 15 | 1.3 | 0 | yes | a |
| Comparative Example 2 | plated | 15 | 1.3 | 0 | yes | a |
| Comparative Example 3 | SPC | 15 | 1.3 | 1400 | no | d |
| Comparative Example 4 | SPC | 15 | 1.3 | 0 | yes | e |
| Example 1 | 450 | 0.9 | 1.2 | grayish black | plates | 6 |
| Example 2 | 450 | 0.9 | 2.8 | grayish white | plates | 4 |

TABLE 1-continued

| Examples And Comparative Examples | Substrate | Phosphate Ions, g/L | Zinc Ions, g/L | Nitrogen Concentration, ppm | Surface Conditioning | Oxidizing Agent * |
|---|---|---|---|---|---|---|
| Example 3 | 80 | 0.6 | 0.9 | grayish black | plates | 8 |
| Example 4 | 1200 | 0.9 | 1.1 | grayish black | plates | 7 |
| Example 5 | 400 | 0.9 | 1.0 | grayish black | plates | 6 |
| Example 6 | 100 | 0.6 | 1.3 | grayish black | plates | 10 |
| Example 7 | 500 | 0.6 | 1.1 | grayish black | plates | 10 |
| Example 8 | 450 | 0.9 | 1.1 | grayish black | plates | 5 |
| Comparative Example 1 | 5 | 0.9 | 0.5 | yellow rust appeared | columnar | 13 |
| Comparative Example 2 | 5 | 0.9 | 0.9 | sparse coating | columnar | 15 |
| Comparative Example 3 | 150 | 0.9 | 0.1 | yellow rust appeared | granular | 80 |
| Comparative Example 4 | 1500 | 0.9 | 0.9 | sparse coating | columnar | 15 |

* Type of oxidizing agents added:
a tert-butyl hydroperoxide
b tert-hexyl hydroperoxide
c peracetic acid
d nitrite ions
e chlorate ions that in this case conversion coating deposition was entirely absent.

A chlorate salt was used by itself as the conversion accelerator in Comparative Example 4. It was found that in this case the conversion reaction rate was substantially slowed.

Benefits of the Invention

The zinc phosphate-based conversion bath according to the present invention for application to metal substrates contains appropriate concentrations of organoperoxide as conversion accelerator. In consequence thereof, this bath yields uniform, fine, and dense conversion coatings with coating weights appropriate for the intended applications. This bath at the same time also acts to induce fine crystal formation in the conversion coating. As a result, the bath has such good effects that a surface-conditioning treatment is no longer a necessity.

The organoperoxides used by the present invention react under mild conditions and are more stable than the generally used inorganic accelerators, and as a consequence have very good economic attributes. Since the presence of nitrogenous compounds in the conversion treatment bath is also no longer a necessity, environmental regulations relating to the levels of nitrogenous compound discharge can now be fully satisfied, and on this point the conversion bath according to the present invention represents a major practical development.

The invention claimed is:

1. An aqueous acidic phosphate conversion coating treatment composition for metal surfaces, said composition consisting essentially of water, zinc ions, phosphate ions, and an accelerating component consisting essentially of one or more organoperoxides.

2. A composition according to claim 1, comprising from 50 to 1,500 ppm of the organoperoxide accelerating component.

3. A composition according to claim 2, having a pH value from 2.0 to 4.0.

4. A composition according to claim 3, having a pH value from about 2.5 to about 3.5.

5. A process for forming a phosphate conversion coating on a metal surface, wherein the metal surface is contacted with an aqueous liquid composition set forth in claim 4.

6. A process according to claim 5, wherein the metal surface, before the formation of a phosphate conversion coating thereon, is degreased and then rinsed with water.

7. A process for forming a phosphate conversion coating on a metal surface, wherein the metal surface is contacted with an aqueous liquid composition set forth in claim 3.

8. A process according to claim 7, wherein the metal surface, before the formation of a phosphate conversion coating thereon, is degreased and then rinsed with water.

9. A process for forming a phosphate conversion coating on a metal surface, wherein the metal surface is contacted with an aqueous liquid composition set forth in claim 2.

10. A process according to claim 9, wherein the metal surface, before the formation of a phosphate conversion coating thereon, is degreased and then rinsed with water.

11. A composition according to claim 1, having a pH value from 2.0 to 4.0.

12. A composition according to claim 11, having a pH value from about 2.5 to about 3.5.

13. A process for forming a phosphate conversion coating on a metal surface, wherein the metal surface is contacted with an aqueous liquid composition set forth in claim 12.

14. A process according to claim 13, wherein the metal surface, before the formation of a phosphate conversion coating thereon, is degreased and then rinsed with water.

15. A process for forming a phosphate conversion coating on a metal surface, wherein the metal surface is contacted with an aqueous liquid composition set forth in claim 11.

16. A process according to claim 15, wherein the metal surface, before the formation of a phosphate conversion coating thereon, is degreased and then rinsed with water.

17. A process for forming a phosphate conversion coating on a metal surface, wherein the metal surface is contacted with an aqueous liquid composition set forth in claim 1.

18. A process according to claim 17, wherein the metal surface, before the formation of a phosphate conversion coating thereon, is degreased and then rinsed with water.

* * * * *